US005299642A

United States Patent [19]

Nelson et al.

[11] Patent Number: 5,299,642

[45] Date of Patent: Apr. 5, 1994

[54] SUBSEA WELLHEAD TIEBACK CONNECTOR

[75] Inventors: John E. Nelson; Lionel J. Milberger, both of Houston, Tex.; Egil Rebne, Stavanger, Norway

[73] Assignee: ABB Vetco Gray Inc., Houston, Tex.

[21] Appl. No.: 914,690

[22] Filed: Jul. 15, 1992

[51] Int. Cl.[5] ..... E21B 43/00

[52] U.S. Cl. ..... 166/368; 166/382

[58] Field of Search ..... 166/363-368, 166/381, 382, 387; 285/24, 39, 83

[56] References Cited

U.S. PATENT DOCUMENTS

| | | | |
|---|---|---|---|
| 4,667,986 | 5/1987 | Johnson et al. | 285/24 |
| 4,691,780 | 9/1987 | Galle, Jr. et al. | 166/368 |
| 4,691,781 | 9/1987 | Gano | 166/368 |
| 4,872,708 | 10/1989 | Abreo, Jr. | 285/39 |
| 4,976,458 | 12/1990 | Hosie et al. | 285/39 |
| 5,143,158 | 9/1992 | Watkins et al. | 166/368 |

*Primary Examiner*—Thuy M. Bui

*Attorney, Agent, or Firm*—James E. Bradley

[57] ABSTRACT

An internal tieback connector for a subsea wellhead housing has a body which lands on the wellhead housing. A funnel extends over the wellhead housing. An internal connector element carried by the body will engage a profile in the wellhead housing. A connector actuator when moved axially downward will actuate the connector element. A tube extends downward from the connector actuator and engages the bore of a casing hanger. A locking device employs slips to allow downward movement of the actuator but prevent upward movement. The locking device can be released. A running tool is hydraulically actuated for moving the actuator downward and releasing the actuator to disconnect the tieback connector.

23 Claims, 5 Drawing Sheets

SUBSEA WELLHEAD TIEBACK CONNECTOR

BACKGROUND OF THE INVENTION

1. Field of the invention:

This invention relates in general to subsea well equipment, and in particular to an apparatus for tying back a wellhead housing located at the sea floor to the surface.

2. Description of the Prior Art:

One type of subsea well employs a wellhead housing located at the sea floor, and a production Christmas tree located at the surface on a platform. Large diameter casing will be lowered from the surface down toward the wellhead housing. A tieback connector will connect the wellhead housing to the riser.

One type of tieback connector has a downward facing funnel that slides over the wellhead housing. The tieback connector has a body with an internal connector device. The connector device will connect to grooves or threads formed in the wellhead housing. Normally, the connection is handled by lowering a running tool and rotating portions of the connector device to move it to a locked position.

While successful, improvements are desired for tieback connectors and running tools wherein large bending forces may be exerted, such as with tension leg platforms.

SUMMARY OF THE INVENTION

In this invention, the internal connector device for the tieback connector is actuated by straight axial movement without rotation. The connector device has a downward extending tube that simultaneously stabs sealingly into a bore of the casing hanger. In addition, a locking device employed with the connector device which will lock the actuating member of the connector device in a lower position and prevent upward movement. This locking device can be selectively released. Also, the invention includes a running tool that will perform the desired operations.

Particularly describing the tieback connector, the body of the tieback connector carries a connector element which will move radially outward to engage a grooved profile in the interior of the wellhead housing. A connector actuator is moved downward to move the locking element outward into the profile. The connector actuator has a tube that extends downward for sealingly engaging the bore of the casing hanger.

The locking means for engaging the connector actuator and holding it in a lower position includes a locking ring that secures to the upper end of the connector actuator. The locking ring has a tapered exterior. A set of slips are carried on the exterior of the locking ring for engaging the bore. The slips wedge against the tapered exterior if an upward force is exerted.

A release member mounts to the locking ring for axial movement relative to the locking ring. The release member has an upper end that contacts the slips. The release member has an engaging profile that is engaged by a running tool to move it upward relative to the locking ring.

The running tool is hydraulically actuated. It includes a locator collet that snaps into a locating groove in the tieback connector body to locate the running tool. A latch piston, when supplied with hydraulic pressure, will move the latch member out to latch the running tool housing to the tieback connector body. At the same time, an engaging piston will move downward to push an engaging member out to engage the engaging profile of the release member of the locking device. The engaging member is carried by the mandrel to lock the mandrel to the actuator member.

When supplied with hydraulic pressure, a mandrel piston will push the mandrel downward relative to the housing. This moves the actuator downward to cause the actuator to connect the tieback connector to the wellhead housing. The locking device automatically locks the actuator in the lower position.

DETAILED DESCRIPTION OF THE INVENTION

Figure 1:
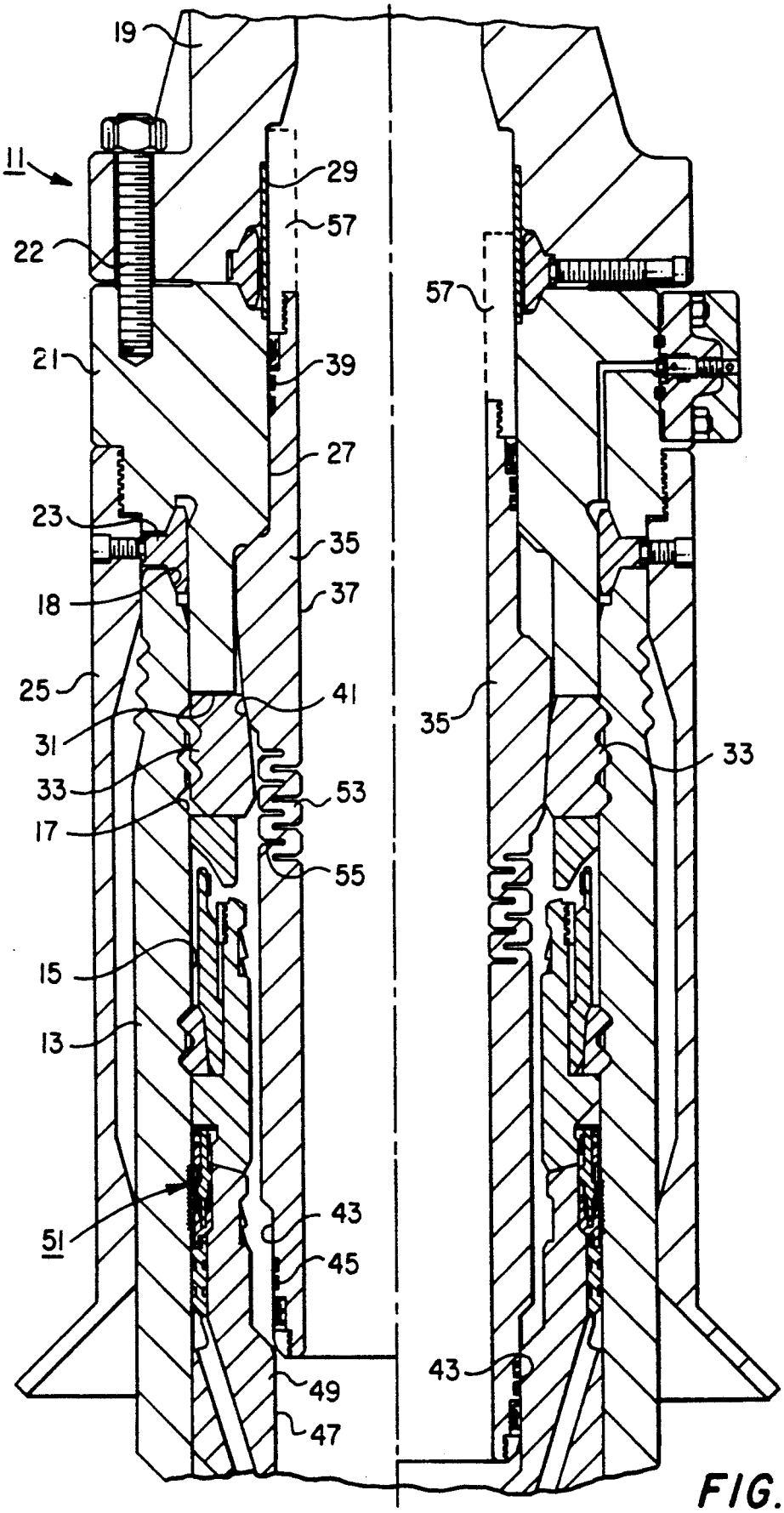
FIG. 1 is a vertical sectional view of a portion of a tieback connector constructed in accordance with this invention, showing a running position on the left side, and a connected position on the right side.

Referring to FIG. 1, tieback connector 11 is shown landed on a subsea wellhead housing 13 in both of the positions of FIG. 1. Wellhead housing 13 is conventional, having a cylindrical bore 15. A grooved profile 17 is formed in bore 15. A seal groove 18 locates at the upper end of wellhead housing 13.

Tieback connector 11 has a body 19, which includes also a lower section 21. Lower section 21 bolts to body 19 by means of bolts 22. A seat or seal 23 locates on the body lower section 21 for engaging seal groove 18. A conventional funnel 25 secures by threads to body lower section 21. Funnel 25 extends slidingly down over wellhead housing 13. Body 19 has a bore 27 that extends through it, including through a bore sleeve 29, which is considered a part of body 19 herein.

Part of lower section 21 of body 19 extends into wellhead housing bore 15. Lower section 21 has a plurality of windows 31 spaced circumferentially around it. A connector element or dog 33 is carried in each window 31. Dogs 33 have profiles on the exterior for serving as a connector member for engaging the grooved profile 17 to connect the body 19 to wellhead housing 13. The dimensions are selected so as to provide a preload force, pulling body 19 tightly downward on seal groove 18 of wellhead housing 13.

An actuator 35 is carried in bore 27 of body 19. Actuator 35 is a tubular member, having a bore 37. Actuator 35 has seals 39 on its upper end for engaging bore 27. A cam surface 41 on the exterior of actuator 35 slidingly engages a mating tapered surface on the inner side of each dog 33. Downward movement of actuator 35 pushes dogs 33 outward, as can be seen by comparing the left side and right side of FIG. 1.

A tube 43 is integrally joined to and extends downward from actuator 35. Seals 45 are located on the lower end of tube 43. Tube 43 is initially spaced above a bore 47 of a casing hanger 49. When actuator 35 moves to the lower position, tube 43 sealingly engages bore 47, as shown on the right side of FIG. 1. Casing hanger 49 is a conventional tieback hanger. It is secured to a string of casing (not shown) and is sealed by casing hanger seal 51 to wellhead housing bore 15.

A flexible means in tube 43 allows the lower end of tube 43 to deflect slight amounts in radial directions to align with bore 47. The flexible means comprises a plurality of interior slots 53 that alternate with exterior slots 55. This results in a serpentine shape to the flexible section located in tube 43 of actuator 35. Slots 53, 55 do not extend completely through the sidewall of tube 43.

Figure 2:
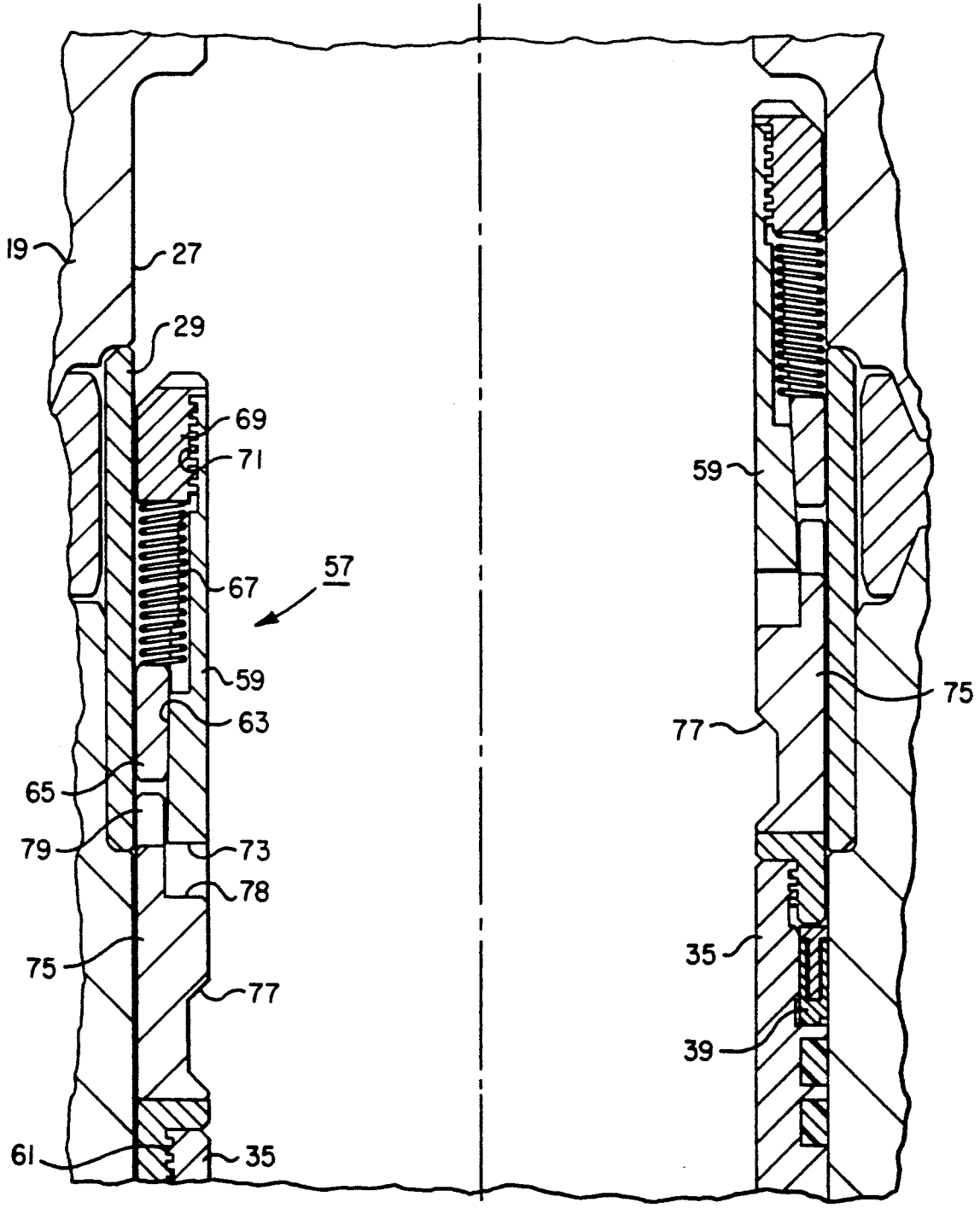
FIG. 2 is a sectional view of an enlarged portion of a locking device for holding the tieback connector of FIG. 1 in the locked position, with the right side showing a running position and the left side the set position.

A locking device 57, shown by dotted lines in FIG. 1, and shown in detail in FIG. 2, will lock the actuator 35 in the lower position shown in the right side of Figure Locking device 57 can be released to allow tieback connector 11 to be removed. Referring to FIG. 2, locking device 57 is shown in a locked position on the left side and in a released position on the right side.

Locking device 57 includes a locking ring 59. Locking ring 59 locates in tieback connector body bore 27, and preferably within bore sleeve 29. Locking ring 59 has threads 61 on its lower end which secure to threads on the upper end of actuator 35. Locking ring 59 has a tapered surface 63 on its exterior that is spaced inward from bore 27.

A plurality of slips 65 locate between tapered surface 63 and bore 27. Slips 65 are wedge shaped, and allow downward movement of locking ring 59, but prevent upward movement of locking ring 59 due to wedging action between tapered surface 63 and bore 27. A plurality of coil springs 67 urge slips 65 downward. A retainer ring 69 secures to threads 71 on the upper end of locking ring 59 to retain springs 67.

Locking ring 59 has a plurality of apertures 73 spaced circumferentially around locking ring 59. A combination engaging and release member 75 locates in each of the apertures 73. Engaging member 75 has a profile 77 on the interior that is adapted to be engaged by a running tool, which will be discussed subsequently. The portion of engaging member 75 that locates within aperture 73 has an axial dimension that is less than the axial dimension of aperture 73. Engaging member 75 thus can move upward and downward a certain distance in each aperture 73. An upward facing shoulder 78 on the upper end of engaging profile 75 will contact the upper edge of aperture 73 when engaging member 75 is in the upper position.

An outer portion of each engaging member 75 locates on the exterior of locking ring 59. Each engaging member 75 has a release member or finger 79 on this outer portion which will locate above aperture 73 radially outward of tapered surface 63 of locking ring 59. In both positions shown in FIG. 2, fingers 79 are spaced below slips 65 by a clearance. Moving engaging members 75 upward relative to locking ring 59 will cause fingers 79 to contact slips 65 and push them upward to a released position (not shown). In the released position, locking ring 59 will be no longer wedged against upward movement by slips 65. Further upward movement of engaging member 75 will cause shoulder 78 to contact the upper surface of aperture 73. This allows force from engaging member 75 to be transmitted through locking ring 59 to actuator 35 to allow unlocking of the tieback connector.

Figure 3A:
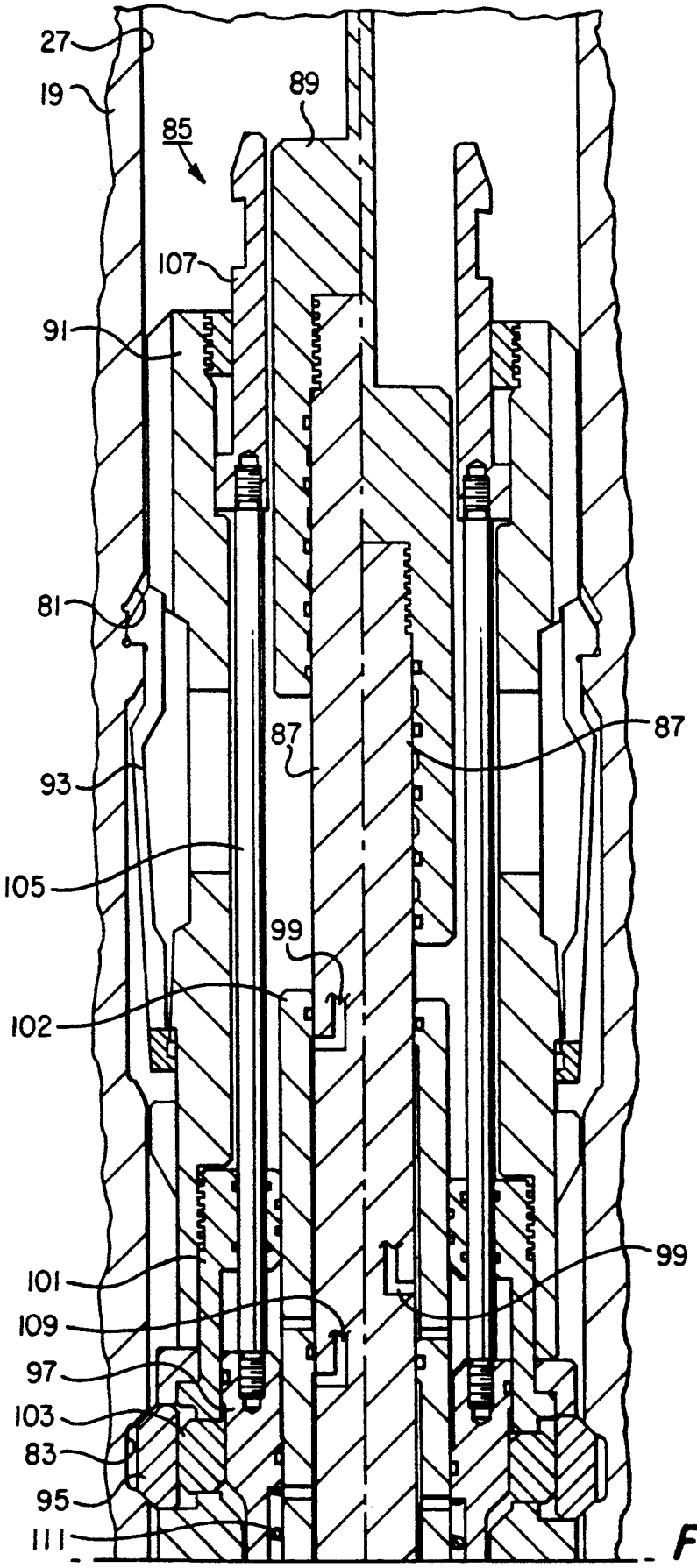
FIGS. 3A, 3B and 3C comprise a vertical sectional view of a running tool for use with the tieback connector of FIG. 1, with portions of the tieback connector body shown in FIG. 3A, and with the running tool shown in a running position on the left side of each figure, and in a set position on the right side of each figure.
Figure 3B:
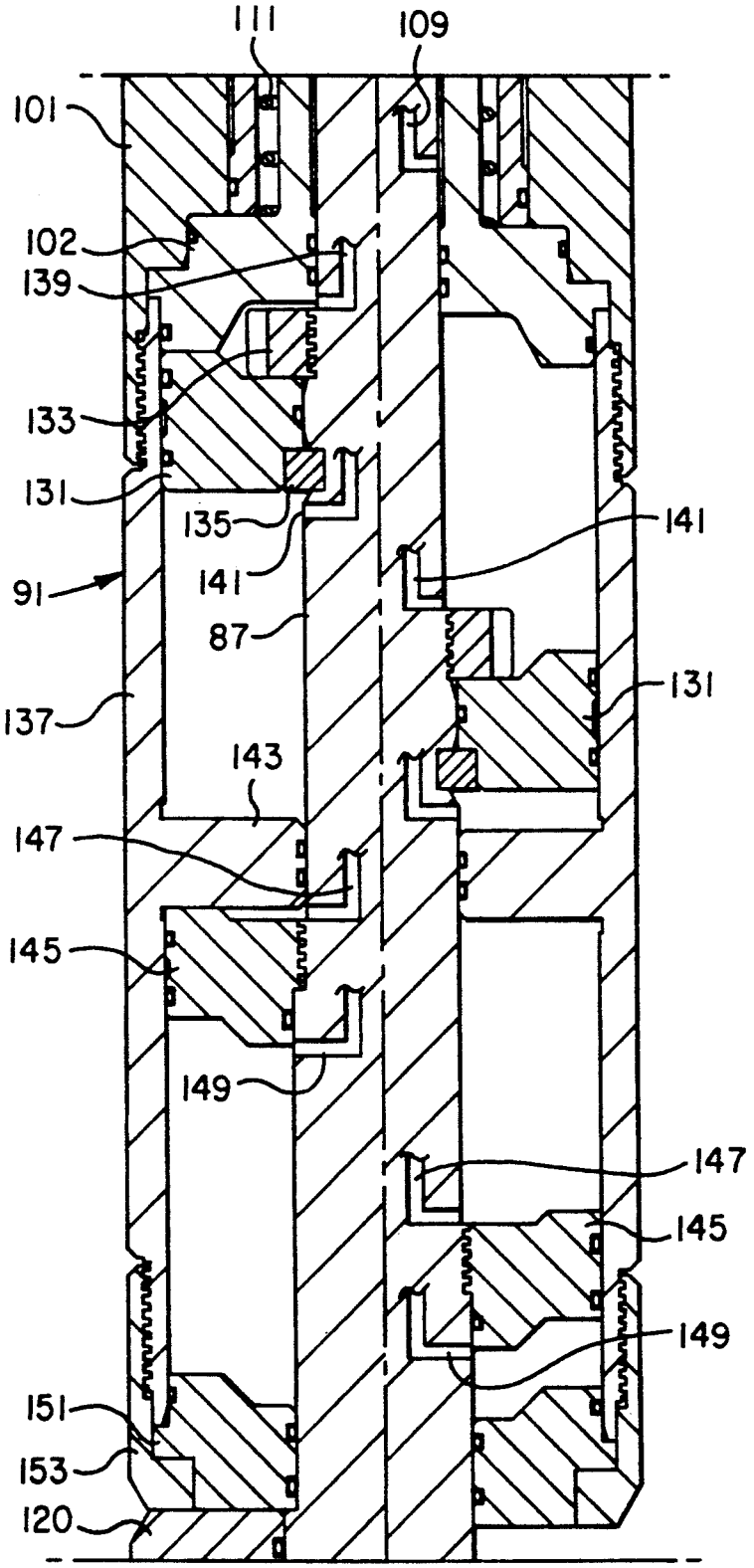
Figure 3C:
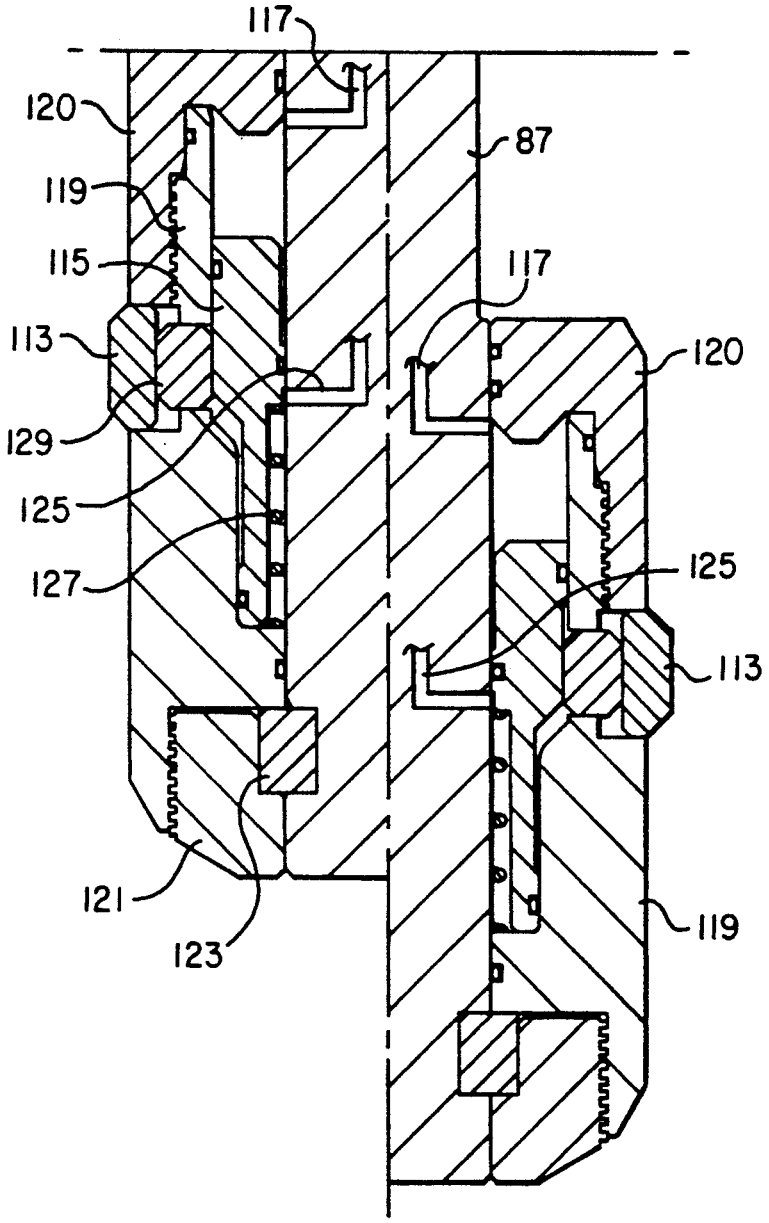

Referring now to FIG. 3A, the tieback connector body 19 will have a locator groove or profile 81 formed in bore 27. A latch profile 83, also a groove, will be located in bore 27 a selected distance below locator profile 81. A running tool 85 will utilize the locator profile 81 and latch profile 83 to accomplish actuation of the actuator 35 (FIG. 1) and locking device 57 (FIG. 2). FIG. 3A shows the running tool 85 and a portion of the tieback connector body 19, while FIGS. 3B and 3C show only the remaining portions of running tool 85, and not other portions of the tieback connector 11 (FIG. 1).

Running tool 85 has a mandrel 87 which has a connector adapter 89 on its upper end. Adapter 89 preferably connects to cable (not shown) for lowering running tool 85 through the tieback conduit or riser and into the tieback connector body 19. Running tool 85 also has a housing 91 that encloses mandrel 87. Mandrel 87 is axially movable relative to housing 91 as will be explained subsequently.

A collet 93 secures to housing 91. Collet 93 is a spring biased member that is urged outward. Collet 93 will slide down the tieback riser and once reaching locator groove 81 will snap into groove 81 to locate running tool 85.

Housing 91 also has a latch 95 which will be positioned adjacent latch profile 83 when collet 93 engages locator profile 81. Latch 95 is preferably a split ring that will move from a retracted position to an expanded position. Both sides of FIG. 3A show the expanded positions with housing 91 latched to tieback connector body 19.

A latch piston 97 in housing 91 moves the latch 95 from the retracted to the expanded positions. Latch piston 97 is supplied with hydraulic pressure from a latch set port 99. Latch set port 99 extends through mandrel 87 and connects to hydraulic conduit that will extend to the surface alongside the cable (not shown) that has lowered running tool 85 into the tieback connector 11.

Latch piston 97 travels reciprocally and axially within a chamber defined by chamber rings 101 and 102. Chamber rings 101 and 102 are rigidly secured to and form a part of housing 91. A plurality of pin or link members 103 locate within apertures in chamber ring 101 between latch piston 97 and latch 95. Latch piston 97 acts against link members 103, which in turn transmit outward force to latch 95.

A plurality of rods 105 extend upward from latch piston 97. Rods 105 secure to a fishing neck 107 at the upper end of running tool 85. This enables running tool 85 to be retrieved in the event of hydraulic failure. A latch return port 109 locates on the retract or lower side of latch piston 97. Return port 109 extends through mandrel 87 and connects to hydraulic conduit extending to the surface. Return port 109 allows the return of hydraulic fluid during the downstroke of latch piston 97. Also, supplying hydraulic pressure to return port 109 will cause latch piston 97 to move upward to release the latch 95. A coil spring 111 biases latch piston 97 upward.

Referring now to FIG. 3C, an engaging member 113, also a split ring, will move between a retracted and an expanded position. In the expanded position, shown on both sides of FIG. 3C, engaging member 113 will engage the profile 77 of engaging member 75 (FIG. 2). An engaging piston 115 will stroke downward to move the engaging member 113 to the expanded position.

An engaging set port 117 supplies hydraulic pressure to stroke engaging piston 115 downward. Engaging piston 115 moves reciprocally and axially within a chamber defined by a chamber ring 119 and an upper end member 120. Chamber ring 119 and upper end member 120 are stationarily secured to mandrel 87, not to housing 91. Retainer rings 121, 123 secure chamber ring 119 to mandrel 87. An engaging return port 125 serves for the return of hydraulic fluid from the opposite side of piston 115. Also, supplying hydraulic fluid pressure to engaging return port 125 will push engaging piston 115 upward to release engaging member 113. A spring 127 biases engaging piston 115 upward. A plurality of pins or link members 129 locate between engaging piston 115 and engaging member 113. Link members 129 locate in a circumferentially spaced apertures provided in chamber ring 119.

Referring to FIG. 3B, a mandrel piston 131 serves to move mandrel 87 downward relative to housing 91 after housing 91 has latched to latch profile 83 and after mandrel 87 has latched to engaging profile 77 (FIG. 2). The right sides of FIGS. 3A, 3B, and 3C show the mandrel 87 in the lower position, while the left sides show the upper position. The downward movement of mandrel 87 will cause actuator 35 (FIG. 1) to move downward. Mandrel piston 131 is secured to mandrel 87 by retainer rings 133 and 135. Mandrel piston 131 locates in a chamber defined by a chamber ring 137 and chamber ring 102. Chamber ring 137 is a stationary part of housing 91. A mandrel port 139 extending through mandrel 87 supplies hydraulic pressure to mandrel piston 131 to move it downward. A mandrel return port 141 allows the return of hydraulic fluid. Also, supplying hydraulic fluid pressure to mandrel return port 141 will move mandrel piston 131 upward.

Chamber ring 137 has two separate chambers separated by a wall 143. A second mandrel piston 145 operates in parallel with mandrel piston 131. Mandrel piston 145 is supplied by hydraulic pressure from mandrel set port 147, with return through mandrel return port 149. Mandrel piston 145 will move reciprocally in unison with mandrel piston 131 in a chamber defined by a chamber end ring 151. Chamber end ring 151 secures to chamber ring 137 by a retainer ring 153.

In operation, referring to FIG. 1, the operator will lower the tieback connector onto wellhead housing 13. Actuator 35 will be in the upper position shown on the left side of FIG. 1. The operator then lowers running tool 85 (FIG. 3A, 3B and 3C) on a cable into tieback connector 11 and actuator 35. When at the proper position, collet 93 will engage locator groove 81.

The operator will then supply hydraulic fluid pressure to latch set port 99, which moves latch piston 97 downward. Latch piston 97 moves latch 95 outward into engagement with latch profile 83. The running tool housing 91 will now be stationarily secured to tieback connector body 19. At the same time, hydraulic fluid pressure is supplied to engaging set port 117 (FIG. 3C). This causes engaging piston 115 to move downward to place engaging member 113 into engagement with engaging member profile 77 (FIG. 2). At this point, the running tool mandrel 87 will be stationarily secured to the engaging members 75 (FIG. 2).

The operator then supplies hydraulic fluid pressure to the mandrel set ports 139 and 147 (FIG. 3B). This causes mandrel pistons 139 and 145 to move downward, forcing mandrel 87 downward at the same time. Engaging member 113 (FIG. 3C) will push downward on engaging member 75 (FIG. 2), pushing actuator 35 (FIG. 1) downward to the lower position. When moving downward, actuator 35 (FIG. 1) will force dogs 33 outward. At the same time, the lower end of tube 43 will slide sealingly into bore 47 of casing hanger 49.

Referring to FIG. 2, during the downward movement, locking ring 59 will move downward in body bore 27. Slips 65 will move downward also. Slips 65 will wedge against tapered surface 63 and bore 27, preventing any upward movement of actuator 35. The tieback connector 11 (FIG. 1) will now be connected and locked to wellhead housing 13.

Once in the lower position, which is shown on the right side of FIGS. 3A, 3B and 3C, the operator will supply hydraulic fluid pressure to latch return port 109 to move latch piston 97 upward, allowing latch 95 to retract from engagement with latch profile 83. At the same time, hydraulic fluid pressure will be supplied to engaging return port 125 (FIG. 3C), which pushes engaging piston 115 upward, allowing engaging member 113 to withdraw from engagement with engaging members 75 (FIG. 2). The operator may then pull the running tool 85 from the subsea well. An upward pull will cause the collet 93 to move back out of engagement with the locator profile 81.

If the operator wishes to disconnect tieback connector 11 from wellhead housing 13, he will then lower the running tool 85 as described. However, the mandrel piston 131 will be initially in the lower position, shown on the right side of FIGS. 3A, 3B, and 3C. After collet 93 has engaged locator profile 81, the operator will supply hydraulic pressure to latch set port 99 (FIG. 3A) to move latch piston 97 downward to cause latch 95 to engage latch profile 83. The operator will move engaging piston 115 downward to cause engaging member 113 to engage engaging member profiles 77 (FIG. 2).

The operator then supplies hydraulic fluid pressure to mandrel return ports 141 and 149 (FIG. 3B) to cause mandrel pistons 139 and 145 to move upward. Mandrel pistons 139, 145 will pull mandrel 87 upward relative to housing 91. This movement causes engaging members 75 to move upward in apertures 73 relative to locking ring 59 (FIG. 2). The release members or fingers 79 will contact the slips 65 to push slips 65 out of engagement with tapered surface 63. Continued upward movement pulls the locking device 57 to the upper position shown on the right side of FIG. 2. Actuator 35 (FIG. 1) will move upward at the same time with locking device 57. This will cause dogs 33 to retract (FIG. 1) to the position shown on the left side of FIG. 1. The tieback connector 11 will now be free of connection to wellhead housing 13.

At that point, the operator will then remove running tool 85. He will do this as before by applying hydraulic fluid pressure to latch return port 109 (FIG. 3A) to cause latch piston 97 to move upward, allowing latch 95 to retract. The operator supplies hydraulic fluid pressure to engaging return port 125 (FIG. 3C) to move engaging piston 115 upward, allowing engaging member 113 to retract from engagement with engaging member profiles 77 (FIG. 2). This frees running tool 85 to be retrieved. The operator then will retrieve tieback connector 11 in a conventional manner.

The invention has significant advantages. The actuator member provides a large preload and at the same time simultaneously connects to the bore of a casing hanger. The locking device locks the actuator in a lower position as the actuator is moved straight axially downward. The running tool is operated with hydraulic fluid pressure, requiring no rotating movements and allowing setting on cable. The running tool will release the locking device to allow the tieback connector to be disconnected if desired.

While the invention has been shown in only one of its forms, it should be apparent to those skilled in the art that it is not so limited, but is susceptible to various changes without departing from the scope of the invention.

We claim:

1. An internal tieback connector for a subsea well having a subsea wellhead housing having a seal groove and a wellhead housing bore containing a grooved profile, the subsea well having a casing hanger secured to the upper end of a string of casing and supported in the wellhead housing, the casing hanger having a casing hanger bore, the tieback connector comprising in combination:

a body having an upper end which secures to a conduit for lowering the body onto the wellhead housing;

a seal carried by the body which lands on the seal groove of the wellhead housing;

a connector element moveably carried by the body for radial movement relative to the body;

a connector actuator carried by the body for axial movement relative to the body between an upper and a lower position, the connector actuator having a cam surface which engages the connector element to move the connector element radially outward into the grooved profile when the connector actuator is moved downward to the lower position;

a tube extending downward from the connector actuator, the tube having a lower end which enters the casing hanger bore when the connector actuator moves to the lower position; and seal means on the lower end of the tube for sealing the exterior of the tube to the casing hanger bore.

2. The tieback connector according to claim 1, further comprising:

flexible means in the tube for allowing radial deflection of the lower end of the tube relative to the connector actuator.

3. The tieback connector according to claim I, further comprising:

flexible means in the tube for allowing radial deflection of the lower end of the tube relative to the connector actuator, the flexible means comprising a plurality of exterior slots formed on the exterior of the tube, and a plurality of interior slots formed in the interior of the tube and alternating with the exterior slots.

4. The tieback connector according to claim 1, wherein the body has a lower section extending downward from the seal for reception in the wellhead housing bore, the lower section having a recess which carries the connector element.

5. The tieback connector according to claim 1, wherein the body has a lower section stationarily joined to the body and extending downward from the seal for reception in the wellhead housing bore, the lower section having a recess which carries the connector element.

6. The tieback connector according to claim 1, wherein:

the body has a lower section stationarily joined to the body and extending downward from the seal for reception in the wellhead housing bore;

the lower section having a plurality of windows extending through the lower section and spaced circumferentially around the lower section; and the connector element comprises a plurality of dogs, each located in one of the windows, each of the dogs having an inner side which is engaged by the cam surface of the connector actuator.

7. The tieback connector according to claim i, further comprising:

locking means engaging the connector actuator and the body for preventing the connector actuator from moving from the lower position to the upper position, the locking means being selectively releasable to allow the connector actuator to move upward to the upper position.

8. The tieback connector according to claim 1, wherein the body has a bore which carries an upper section of the connector actuator, and wherein the tieback connector further comprises:

locking means mounted to the connector actuator and including slips which slidingly engage the bore of the body for preventing the connector actuator from moving from the lower position to the upper position; and wherein the locking means includes releasing means for releasing the slips to allow the connector actuator to move upward to the upper position.

9. A method of tying back a subsea well, the subsea well having a subsea wellhead housing, the wellhead housing having a wellhead housing bore containing a grooved profile, the subsea well having a casing hanger secured to the upper end of a string of casing and supported in the wellhead housing, the casing hanger having a casing hanger bore, the method comprising in combination:

providing a tieback connector with a body;

mounting a connector element to the body for radial movement relative to the body;

mounting a connector actuator in the body for axial movement relative to the body, and providing the connector actuator with a cam surface;

providing the connector actuator with a tube extending downward therefrom, and providing a lower end of the tube with a seal;

securing a tieback connector body to a conduit and lowering the body onto the wellhead housing; then lowering a running tool into the body and moving the connector actuator downward, causing the cam surface to move the connector element radially outward into the grooved profile and to cause the lower end of the tube to enter and seal in the bore of the casing hanger.

10. The method according to claim 9, further comprising:

mounting a locking assembly with a set of slips to the locking actuator;

mounting an engaging member to the locking assembly below the slips;

causing the slips of the locking assembly to engage the body as the connector actuator is moved downward to prevent the connector actuator from moving upward; and engaging the engaging member with the running tool and moving the engaging member upward relative to the slips to release the slips and move the cam surface upward to disconnect the tieback connector.

11. An internal tieback connector for a subsea well having a subsea wellhead housing having a seal groove and a wellhead housing bore containing a grooved profile, the subsea well having a casing hanger secured to the upper end of a string of casing and supported in the wellhead housing, the casing hanger having a casing hanger bore, the tieback connector comprising in combination:

a body having a bore and an upper end which secures to a conduit for lowering the body onto the wellhead housing;

a funnel extending downward from the body for reception over the wellhead housing;

a connector element moveably carried by the body for radial movement relative to the body;

a connector actuator carried in the bore of the body for axial movement relative to the body between an upper and a lower position, the connector actuator having a cam surface which engages the connector element to move the connector element radially outward into the grooved profile when the connector actuator is moved downward to the lower position;

locking means mounted to the connector actuator and including slips which slidingly engage the bore of the body for preventing the connector actuator from moving from the lower position to the upper position; and the locking means having release means for releasing the slips to allow the connector actuator to move upward from the lower position to the upper position.

12. The tieback connector according to claim wherein the locking means comprises:

a locking ring secured to the actuator for movement therewith, the locking ring having an exterior with a tapered surface;

the slips being carried between the tapered surface of the locking ring and the bore of the body;

spring means mounted to the locking ring for urging the slips downward relative to the locking ring so as to wedge the slips between the bore of the body and the locking ring if an upward force is exerted on the locking ring; and wherein the release means selectively moves the slips upward relative to the locking ring to release the locking ring for upward movement relative to the body.

13. The tieback connector according to claim 11 wherein the locking means comprises:

a locking ring secured to the actuator for movement therewith, the locking ring having an exterior with a tapered surface;

the slips being carried between the tapered surface of the locking ring and the bore of the body;

spring means mounted to the locking ring for urging the slips downward relative to the locking ring so as to wedge the slips between the bore of the body and the locking ring if an upward force is exerted on the locking ring; and wherein the release means comprises:

a release member mounted to the locking ring for axial movement relative to the locking ring between a lower locking position wherein an upper end of the release member is spaced below the slips and an upper release position wherein the upper end of the release member contacts the slips for selectively moving the slips upward relative to the locking ring to release the locking ring for upward movement relative to the body.

14. The tieback connector according to claim 11 wherein the locking means comprises:

a locking ring secured to the actuator for movement therewith, the locking ring having an exterior with a tapered surface, the locking ring having a plurality of windows;

the slips being carried between the tapered surface of the locking ring and the bore of the body;

spring means mounted to the locking ring for urging the slips downward relative to the locking ring so as to wedge the slips between the bore of the body and the locking ring if an upward force is exerted on the locking ring; and wherein the release means comprises:

a plurality of apertures spaced circumferentially around the locking ring;

a plurality of release members , each carried in one of the apertures for axial movement relative to the locking ring, each of the release members being engageable by a running tool lowered through the locking sleeve for moving the release members upward relative to the locking sleeve, each release member contacting at least one of the slips to move the slips upward relative to the locking ring to release the locking ring.

15. In a subsea well having a tubular body having a bore, a tubular member carried in the bore for axial movement between a lower position and an upper position, an apparatus for releasably locking the tubular member in the lower position, comprising in combination:

a locking ring secured to the tubular member for axial movement therewith, the locking ring having an exterior with a tapered surface;

a plurality of slips carried between the tapered surface of the locking ring and the bore of the body;

spring means mounted to the locking ring for urging the slips downward relative to the locking ring so as to wedge the slips between the bore of the body and the locking ring if an upward force is exerted on the locking ring; and release means for selectively moving the slips upward relative to the locking ring to release the locking ring for upward movement relative to the body.

16. The apparatus according to claim 15, wherein the release means comprises:

a release member mounted to the locking ring for axial movement relative to the locking ring between a lower locking position wherein an upper end of the release member is spaced below the slips and an upper release position wherein the upper end of the release member contacts the slips for selectively moving the slips upward relative to the locking ring to release the locking ring for upward movement relative to the body.

17. The apparatus according to claim 15, wherein the release means comprises:

a plurality of apertures formed in and spaced circumferentially around the locking ring;

a plurality of release members, each mounted to the one of the apertures for axial movement relative to the locking ring between a lower locking position wherein upper ends of the release members are spaced below the slips and an upper release position wherein the upper ends of the release members contact the slips for selectively moving the slips upward relative to the locking ring to release the locking ring for upward movement relative to the body.

18. In a subsea well having a tubular body having a bore, a tubular member carried in the bore for axial movement between a lower position and an upper position, an apparatus for releasably locking the tubular member in the lower position, comprising in combination:

a locking ring secured to the tubular member for axial movement therewith, the locking ring having an exterior with a tapered surface;

a plurality of slips carried between the tapered surface of the locking ring and the bore of the body;

spring means mounted to the locking ring for urging the slips downward relative to the locking ring so as to wedge the slips between the bore of the body and the locking ring if an upward force is exerted on the locking ring;

a plurality of apertures formed in and circumferentially spaced around the locking ring;

a plurality of release members, each mounted to the one of the apertures for axial movement relative to the locking ring between a lower locking position wherein upper ends of the release members are spaced below the slips and an upper release position wherein the upper ends of the release members contact the slips for selectively moving the slips upward relative to the locking ring to release the locking ring for upward movement relative to the body; and running tool means lowered through the locking sleeve for engaging the release members to move the locking sleeve and the tubular member downward to lock the tubular member in the lower position, and to selectively pull the release members upward relative to the locking sleeve to move the release members upward to the release position.

19. A method for releasably locking a tubular member in the lower position in a tubular body having a bore in a subsea well, comprising:

mounting a locking ring to the tubular member for axial movement therewith;

mounting a plurality of slips to exterior of the locking ring;

continuously urging the slips downward relative to the locking ring;

moving the tubular member downward in the tubular body, causing the slips to wedge between the bore of the body and the locking ring, thereby preventing the locking ring from moving upward if an upward force is exerted on the locking ring; and selectively moving the slips upward relative to the locking ring to release the locking ring for upward movement relative to the body.

20. The method according to claim 19, wherein the step of selectively moving the slips upward comprises:

mounting a release member to the locking ring for axial movement relative to the locking ring between a lower locking position wherein an upper end of the release member is spaced below the slips and an upper release position wherein the upper end of the release member contacts the slips; and moving the release member upward relative to the locking ring to the upper position, thereby engaging and moving the slips upward relative to the locking ring to release the locking ring for upward movement relative to the body.

21. A running tool for setting and releasing a tubular member, the tubular member being located in a subsea well having a tubular body having a bore containing a latch profile, the tubular member being carried in the bore for axial movement between an upper position and a lower position, the tubular member having a bore with an engaging profile, the running tool comprising in combination:

a running tool housing adapted to be lowered into the bore of the tubular member;

a latch member carried by the running tool housing for radial movement between a retracted position and an expanded position in engagement with the latch profile in the bore of the tubular body;

latch piston means carried by the running tool housing and connected to a source of hydraulic pressure for moving the latch member to the expanded position to secure the running tool housing to the tubular body;

a mandrel located in the running tool housing;

an engaging member carried by the mandrel for radial ,movement between a retracted position and an expanded position in engagement with the engaging profile in the bore of the tubular member;

engaging piston means carried by the running tool housing and connected to a source of hydraulic pressure for moving the engaging member to the expanded position; and mandrel piston means carried by the running tool housing and connected to a source of hydraulic pressure for moving the mandrel downward relative to the running tool housing after the latch member and engaging member re in the expanded positions, to move the tubular member downward to the lower position to set the tubular member, and selectively to return the tubular member back to the upper position to release the tubular member.

22. The running tool according to claim 21, wherein the bore of the tubular body has a locator profile, and wherein the running tool further comprises:

a spring biased locating member mounted to the housing for springing outward into engagement with the locator profile to position the running tool axially prior to actuating the latch piston means.

23. A method for setting and releasing a tubular member located in a subsea well, the subsea well having a tubular body having a bore containing a latch profile, the tubular member being carried in the bore for axial movement between an upper position and a lower position, the tubular member having a bore with an engaging profile, the running tool comprising in combination:

providing a running tool housing;

mounting a latch member to the running tool housing for radial movement between a retracted position and an expanded position;

mounting a latch piston to the running tool housing;

mounting a mandrel in the running tool housing;

mounting an engaging member to the mandrel for radial movement between a retracted position and an expanded position;

mounting an engaging piston to the running tool housing;

mounting a mandrel piston to the running tool housing;

lowering the running tool into the bore of the tubular member;

supplying hydraulic pressure to the latch piston and by movement of the latch piston moving the latch member to the expanded position in engagement with the latch profile in the bore of the tubular body to secure the running tool housing to the tubular body;

supplying hydraulic pressure to the engaging member piston and by movement of the engaging member piston moving the engaging member into engagement with the engaging profile in the bore of the tubular member; then supplying hydraulic pressure to the mandrel piston and by movement of the mandrel piston moving the mandrel downward relative to the running tool housing to move the tubular member downward to the lower position to set the tubular member; then supplying hydraulic pressure to retract sides of the latch piston and engaging piston to release the running tool from the tubular member and the tubular body.

* * * * *